US008122669B2

(12) United States Patent
Legnini et al.

(10) Patent No.: US 8,122,669 B2
(45) Date of Patent: Feb. 28, 2012

(54) WOODEN ROOF TRUSS

(76) Inventors: Enzo Legnini, Kingston (CA); Santo Mazzeo, Kingston (CA); Juergen Fuchs, Verona (CA)

( * ) Notice: Subject to any disclaimer, the term of this patent is extended or adjusted under 35 U.S.C. 154(b) by 314 days.

(21) Appl. No.: 12/379,567

(22) Filed: Feb. 25, 2009

(65) Prior Publication Data

US 2009/0293408 A1 Dec. 3, 2009

Related U.S. Application Data

(60) Provisional application No. 61/064,305, filed on Feb. 27, 2008.

(51) Int. Cl.
*E04C 3/42* (2006.01)

(52) U.S. Cl. ..... 52/573.1; 52/655.1; 52/640; 52/643; 52/639

(58) Field of Classification Search ..... 52/643, 52/644, 712, 639, 633, 693, 640, 641, 90.1, 52/573.1, 646, 655.1
See application file for complete search history.

(56) References Cited

U.S. PATENT DOCUMENTS

| | | | | | |
|---|---|---|---|---|---|
| 2,840,014 | A * | 6/1958 | McKinley et al. | 52/639 |
| 2,844,852 | A * | 7/1958 | West | 411/466 |
| 3,011,226 | A * | 12/1961 | Menge | 411/466 |
| 3,068,483 | A * | 12/1962 | Moehlenpah et al. | 100/193 |
| 3,100,301 | A * | 8/1963 | Black | 227/152 |
| 3,449,997 | A * | 6/1969 | Couch | 411/466 |
| 3,457,689 | A * | 7/1969 | Troutner | 52/639 |
| 3,605,355 | A * | 9/1971 | Solesbee | 52/90.1 |
| 3,731,583 | A * | 5/1973 | Jureit | 411/466 |
| 3,736,708 | A * | 6/1973 | Chapman | 52/92.2 |
| 3,760,550 | A * | 9/1973 | Mueller et al. | 52/641 |
| 3,823,522 | A * | 7/1974 | Jureit et al. | 52/641 |
| 3,867,803 | A * | 2/1975 | Platt | 52/693 |
| 3,890,747 | A * | 6/1975 | Van Der Lely | 52/64 |
| 3,950,109 | A * | 4/1976 | Smith | 403/403 |
| 4,274,241 | A * | 6/1981 | Lindal | 52/642 |
| 4,974,387 | A * | 12/1990 | Dufour | 52/639 |
| 5,361,495 | A | 11/1994 | Pyle et al. | |
| 5,577,353 | A * | 11/1996 | Simpson | 52/92.2 |
| 6,047,504 | A * | 4/2000 | Dusenberry | 52/92.2 |
| 6,842,981 | B2 | 1/2005 | Kennelly et al. | |
| 2002/0046514 | A1 * | 4/2002 | Leung | 52/167.3 |
| 2005/0166522 | A1 * | 8/2005 | Griffith | 52/633 |
| 2005/0247004 | A1 * | 11/2005 | Sardi Herrera | 52/633 |
| 2006/0201097 | A1 * | 9/2006 | Davis | 52/633 |

* cited by examiner

*Primary Examiner* — Robert Canfield
*Assistant Examiner* — Babajide Demuren
(74) *Attorney, Agent, or Firm* — Frank J. Bonini, Jr.; John F. A. Earley, III; Harding, Earley, Follmer & Frailey, P.C.

(57) ABSTRACT

A roof truss is provided comprising a bottom chord, a first top chord, and a second top chord forming a triangle with an apex at a distance A above the bottom chord. At least a web member is disposed between the top chords and the bottom chord such that, in a first state of operation, the at least a web member is capable of transmitting at least one of a tension force and a compression force between the top chords and the bottom chord. The roof truss further comprises at least an expandable interface for expandable interfacing at least one of the at least a web member with one of the chords for enabling, in a second state of operation, expansion of the distance A to an extent that uplift of the bottom chord is substantially reduced.

15 Claims, 14 Drawing Sheets

WOODEN ROOF TRUSS

FIELD OF THE INVENTION

This application claims the benefit of U.S. Provisional Patent Application No. 61/064,305 filed Feb. 27, 2008, the entire contents of which are incorporated herein by reference.

The instant invention relates to the field of wooden roof trusses and in particular to a wooden roof truss having an expandable interface for substantially reducing roof truss uplift.

BACKGROUND

Most present-day roof trusses form a triangular structure comprising a bottom chord and two inclined top chords which meet in an apex at a predetermined distance—rise—above the bottom chord. The bottom chord and the top chords are joined by web members forming triangular substructures of the roof truss. Each of the web members transmits one of a tension force and a compression force between one of the two top chords and the bottom chord depending on load acting on the roof truss.

Air in a well-ventilated attic space contains approximately a same amount of moisture as outside air. In winter the relative humidity of the outside air is relatively high, therefore, the top chords and web members absorb moisture until equilibrium is reached with the outside air. Consequently, the top chords and the web members lengthen.

The bottom chord, however, experiences a different phenomenon. In order to meet building code requirements of colder climate zones, builders cover the bottom chord with an approximately 300 mm thick layer of insulating material. Therefore, the average temperature surrounding the bottom chord is close to the indoor temperature. This causes the air adjacent to the bottom chord to have a much lower relative humidity than the air outside the layer of insulating material. As a result, the air adjacent to the bottom chord absorbs moisture from the wood causing the bottom chord to shorten.

As the bottom chord shortens and the top chords lengthen—which is not compensated by the lengthening of the web members—the apex of the roof truss is forced upward. Thus, web members connected to the top chords near the apex pull the bottom chord upward resulting in a roof truss uplift causing cracks of up to approximately 20 mm width between ceilings and partitioning walls. It is worth noting, that in case the chords and the web members are made of compression wood or juvenile wood, this effect is significantly increased.

Some builders mask the effects of the roof truss uplift by securing the ceiling drywall to the top of the partitioning walls and not to the roof trusses for a distance of approximately 45 cm from the partitioning walls. The drywall flexes and stays fastened to the partitioning walls while the trusses lift above it. Unfortunately, this method leaves a considerable portion of the ceiling drywall without support. Furthermore, mounting of fixtures such as hanging light fixtures to this portion of the ceiling is difficult if not impossible.

Others fasten decorative moldings to the ceilings along edges where the partitioning walls and the ceilings meet. As the ceilings move up, the moldings move therewith, thus hiding the gap. Unfortunately, since colors change when exposed to sunlight this will expose an undecorative stripe below the molding in winter. Furthermore, it is suggested to always redecorate in winter when the ceiling is at its highest point. Otherwise a stripe will be exposed below the molding during the following winter.

It would be highly desirable to overcome these drawbacks and to substantially reduce roof truss uplift.

SUMMARY OF EMBODIMENTS OF THE INVENTION

In accordance with an aspect of the present invention there is provided a wooden roof truss comprising:

a bottom chord, a first top chord, and a second top chord, the bottom chord, the first top chord, and the second top chord joined together forming a triangle with an apex spaced at a distance A from the bottom chord;

a web member disposed between the top chords and the bottom chord such that, in a first state of operation, the a web member transmits one of a tension force and a compression force between the top chords and the bottom chord; and, an expandable interface for expandably interfacing the web member with one of:

the first top chord;

the second top chord;

the first and the second top chord; and, the bottom chord, wherein the expandable interface supports, in a second state of operation, variation of the distance A between the apex and the bottom chord.

In accordance with an aspect of the present invention there is further provided a wooden roof truss comprising:

a bottom chord, a first top chord, and a second top chord, the bottom chord, the first top chord, and the second top chord joined together forming a triangle with an apex spaced at a distance A from the bottom chord;

a web member disposed between at least one of the top chords and the bottom chord such that, in a first state of operation, the web member transmits one of a tension force and a compression force between the at least one of the top chords and the bottom chord, wherein the web member comprises an expandable interface disposed between a first and a second portion of the web member for supporting relative movement of the first portion with respect to the second portion substantially along a longitudinal axis of the web member for supporting, in a second state of operation, variation of the distance A between the apex and the bottom chord.

BRIEF DESCRIPTION OF THE FIGURES

Exemplary embodiments of the invention will now be described in conjunction with the following drawings, in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1A:
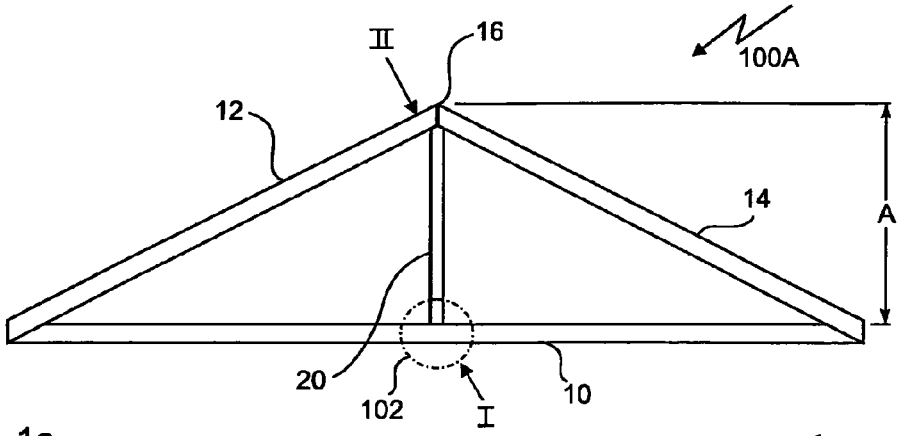
Fig. 1a (PRIOR ART)
FIGS. 1*a* to 1*e* are simplified block diagrams illustrating various examples of triangular wooden roof trusses according to embodiments of the invention.
Figure 1B:
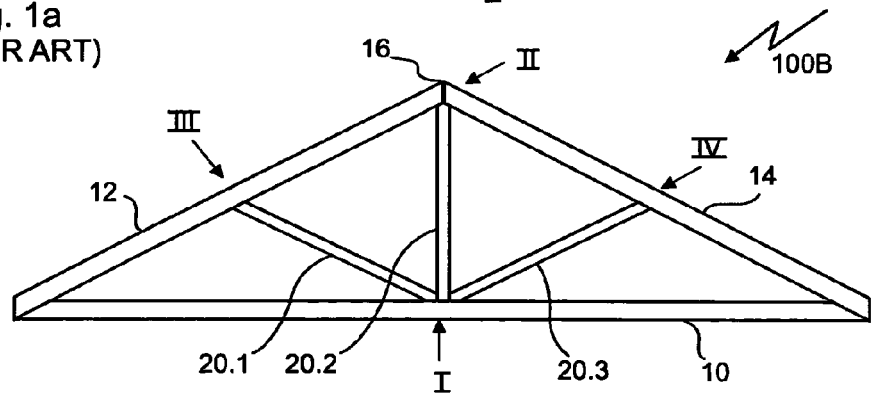
Fig. 1b (PRIOR ART)
Figure 1C:
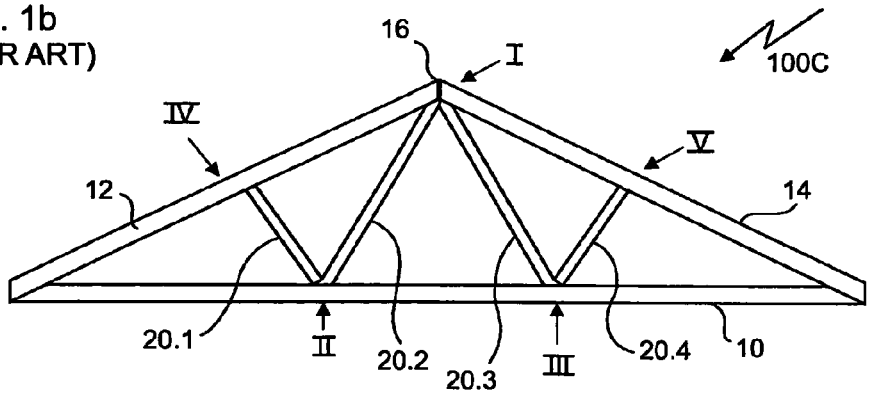
Fig. 1c (PRIOR ART)
Figure 1D:
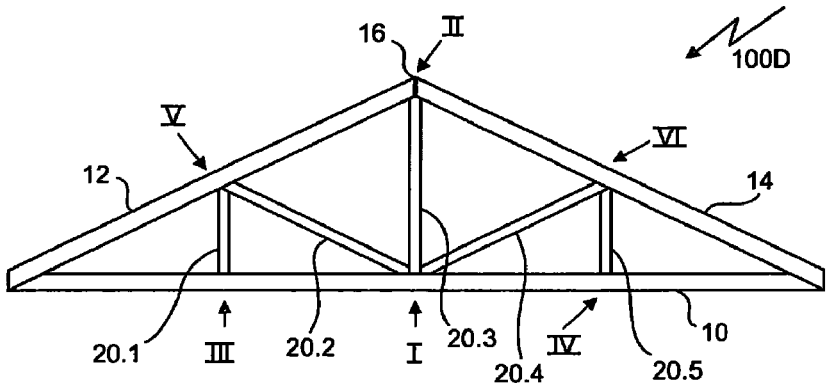
Fig. 1d (PRIOR ART)
Figure 1E:
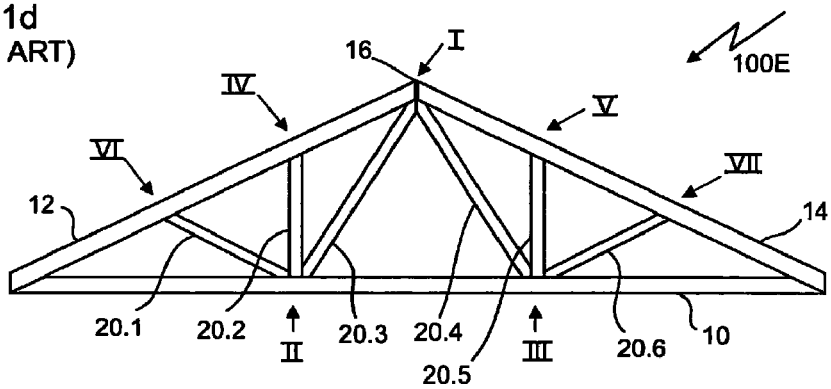
Fig. 1e (PRIOR ART)

Referring to FIGS. 1*a* to 1*e*, simplified block diagrams illustrating various examples of triangular wooden roof trusses 100A to 100E according to embodiments of the invention are shown. The example wooden roof trusses 100A to 100E according to embodiments of the invention are related to standard roof truss shapes which are:

King Post roof truss, shown in FIG. 1*a;*
Queen Post roof truss, shown in FIG. 1*b;*
Fink roof truss, shown in FIG. 1*c;*
Howe roof truss, shown in FIG. 1*d*; and,
Fan roof truss, shown in FIG. 1*e.*

While the embodiments of the invention will be described based on the standard roof truss shapes shown in FIGS. 1*a* to 1*e* for the sake of simplicity, it will become evident to those skilled in the art that it is possible to implement the invention in various other roof truss shapes such as, for example, Modified Queen Post, Double Fink, Double Howe, Double Fan, and Dual Pitch, as well as non-standard roof truss shapes.

Figure 2:
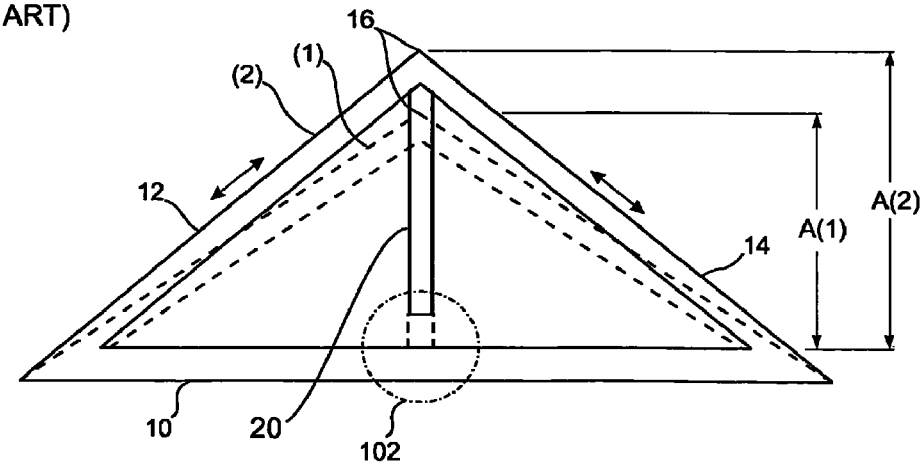
FIGS. 2 to 4 are simplified block diagrams illustrating triangular wooden roof trusses according to embodiments of the invention.

As shown in FIGS. 1*a* to 1*e*, each of the example roof trusses 100A to 100E comprise a bottom chord 10, a first top chord 12, and a second top chord 14. The bottom chord 10, the first top chord 12, and the second top chord 14 form a triangle with an apex 16 at a distance A above the bottom chord 10. A different number of web members are disposed between the top chords—12 and 14—and the bottom chord 10 depending on the roof truss shape, i.e. one web member 20 in the case of the King Post roof truss; three web members 20.1 to 20.3 in the case of the Queen Post roof truss; four web members 20.1 to 20.4 in the case of the Fink roof truss; five web members 20.1 to 20.5 in the case of the Howe roof truss; and six web members 20.1 to 20.6 in the case of the Fan roof truss. The web members 20, 20.*x* are disposed such that, in a first state of operation, they transmit a tension force or a compression force between the top chords—12 and 14—and the bottom chord 10. The first state of operation refers to a state where the top chords—12 and 14—as well as the bottom chord 10 are exposed to a same level of relative humidity, while a second state of operation refers to a state where the top chords—12 and 14—are exposed to a substantially higher level of relative humidity than the bottom chord, i.e. the top chords—12 and 14—are lengthened while the bottom chord 10 is likely shortened. In order to compensate the lengthening of the top chords—12 and 14—at least one expandable interface 102 is used for expandably interfacing at least one of the web members, as shown in FIG. 2 for the simplest case of the King Post roof truss. As shown in FIG. 2 lengthening of the top chords—12 and 14—causes an upward movement of the apex 16, i.e. the distance A increases from distance A(1) to distance A(2). By using the expandable interface 102 in the wooden roof truss according to an embodiment of the invention, expansion of the distance A is enabled and, therefore, uplift of the bottom chord is substantially reduced, as shown in FIG. 2.

As is evident, there are numerous possibilities of placing the expandable interface 102 in the wooden roof truss according to the invention. Regarding the King Post roof truss shown in FIG. 1*a*, the expandable interface 102 optionally is placed at intersection I of the web member 20 with the bottom chord 10 or, alternatively, at intersection II of the web member 20 with the top chords 12 and 14. Regarding the Queen Post roof truss shown in FIG. 1*b*, the expandable interface 102 optionally is placed at intersection I of the three web members 20.1 to 20.3 with the bottom chord 10, at intersections II, III, and IV of the three web members 20.1 to 20.3 with the top chords 12 and 14 or, alternatively, only at intersection II of the web member 20.2 with the top chords 12 and 14. Depending on the size, the design of the Queen Post roof truss and the lengthening of the top chords, it is possible to substantially reduce the uplift of the bottom chord 10 by using only one expandable interface 102 at the intersection II. Regarding the Fink roof truss shown in FIG. 1*c*, the expandable interface 102 optionally is placed at intersections II and III of the four web members 20.1 to 20.4 with the bottom chord 10, at intersections I, IV, and V of the four web members 20.1 to 20.4 with the top chords 12 and 14 or, alternatively, only at intersection I of the web members 20.2 and 20.3 with the top chords 12 and 14. Again, depending on the size, the design of the Fink roof truss and the lengthening of the top chords, it is possible to substantially reduce the uplift of the bottom chord 10 by using only one expandable interface 102 at the intersection I. Regarding the Howe roof truss shown in FIG. 1*d*, the expandable interface 102 optionally is placed at intersections I, III and IV of the five web members 20.1 to 20.5 with the bottom chord 10, at intersections II, V, and VI of the five web members 20.1 to 20.5 with the top chords 12 and 14 or, alternatively, only at intersection II of the web member 20.3 with the top chords 12 and 14. Again, depending on the size, the design of the Howe roof truss and the lengthening of the top chords, it is possible to substantially reduce the uplift of the bottom chord 10 by using only one expandable interface 102 at the intersection II. Regarding the Fan roof truss shown in FIG. 1*e*, the expandable interface 102 optionally is placed at intersections II and III of the six web members 20.1 to 20.6 with the bottom chord 10, at intersections I, IV, V, VI and VII of the six web members 20.1 to 20.6 with the top chords 12 and 14 or, alternatively, at intersections I, IV and V of the four web members 20.2 to 20.5 with the top chords 12 and 14.

Figure 3:
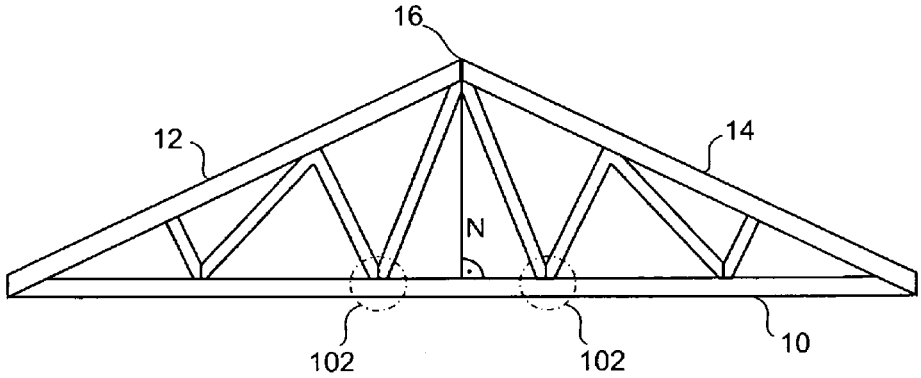

Of course, there are numerous other possibilities for placing the expandable interface 102. It is noted that the expandable interface(s) is more effective in reducing uplift of the bottom chord 10 when placed such that the web members placed in closer proximity to a normal N to the bottom chord 10 through the apex 16 are expandably interfaced than the web members placed at a larger distance to the normal N, as shown in the example of a Double Fink roof truss in FIG. 3.

Figure 4:
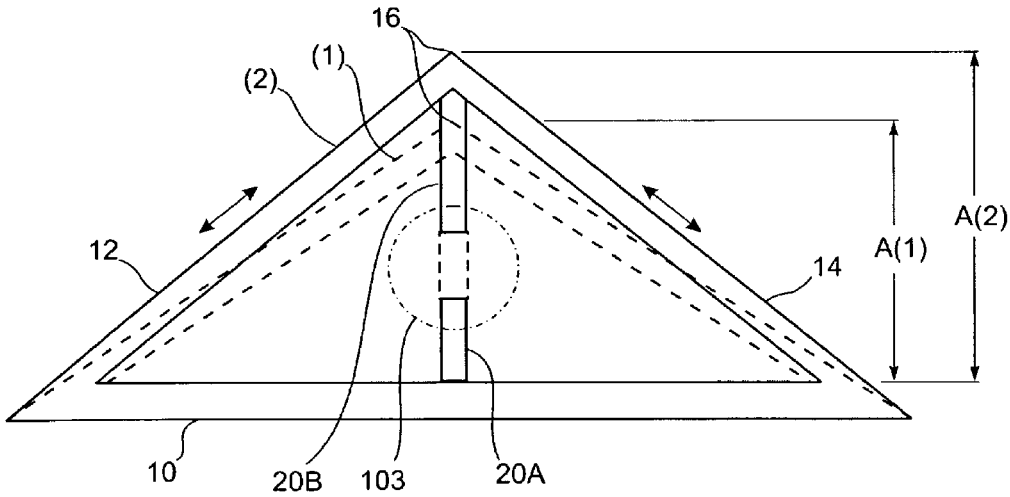

Alternatively, an expandable interface 103 is interposed between a first portion 20A and a second portion 20B of an expandable web member of the wooden roof truss according to an embodiment of the invention, as shown in the simplified block diagram in FIG. 4. Here, the expandable interface 103 enables relative movement of the first portion 20A with respect to the second portion 20B substantially along a longitudinal axis of the web member. By using the expandable interface 102 in the wooden roof truss according to the embodiment of the invention, expansion of the distance A—from distance A(1) to distance A(2)—is enabled and, therefore, uplift of the bottom chord is substantially reduced, as shown in FIG. 4.

As is evident, there are numerous possibilities of placing the expandable interface 103 in the wooden roof truss according to the invention. Regarding the Queen Post roof truss shown in FIG. 1*b*, the expandable interface 103 optionally is placed in the web member 20.2 or, alternatively, in all three web members 20.1 to 20.3. Regarding the Fink roof truss shown in FIG. 1*c*, the expandable interface 103 optionally is placed in the web members 20.2 and 20.3 or, alternatively, in all four web members 20.1 to 20.4. Of course, there are numerous other possibilities of placing the expandable interface 103, as well as combinations with the expandable interface 102 above.

Typically, in North America wooden roof trusses are manufactured using a standard size of 2"×6" for the chords, i.e. the chords have a substantially rectangular cross section—oriented perpendicular to a longitudinal axis of the chord—of approximate size of ½"×3 ½", and a standard size of 2"×4" for the web members, i.e. the web members have a substantially rectangular cross section—oriented perpendicular to a longitudinal axis of the web member—of size 1½"×2½". The chords and web members are typically joined at the various intersections using "nail plates"—metal plates having integral teeth—nails—punched from the plate material—which are placed on the front side and the backside of the respective components of the wooden roof truss to be joined and the nails are then driven into the wood using hydraulic clamps. While the invention will be described hereinbelow based on this typical manufacturing process, it will become evident to those skilled in the art that the invention is not limited thereto but is also applicable using different sizes and different methods of joining the components such as, for example, using an adhesive.

Figure 5A:
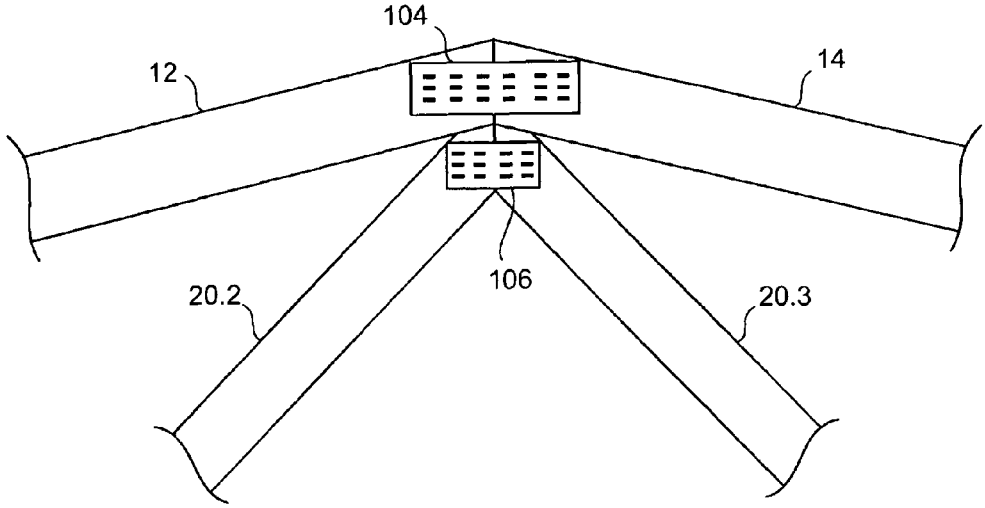
FIGS. 5*a* and 5*b* are simplified block diagrams of a first embodiment of an expandable interface according to the invention.
Figure 5B:
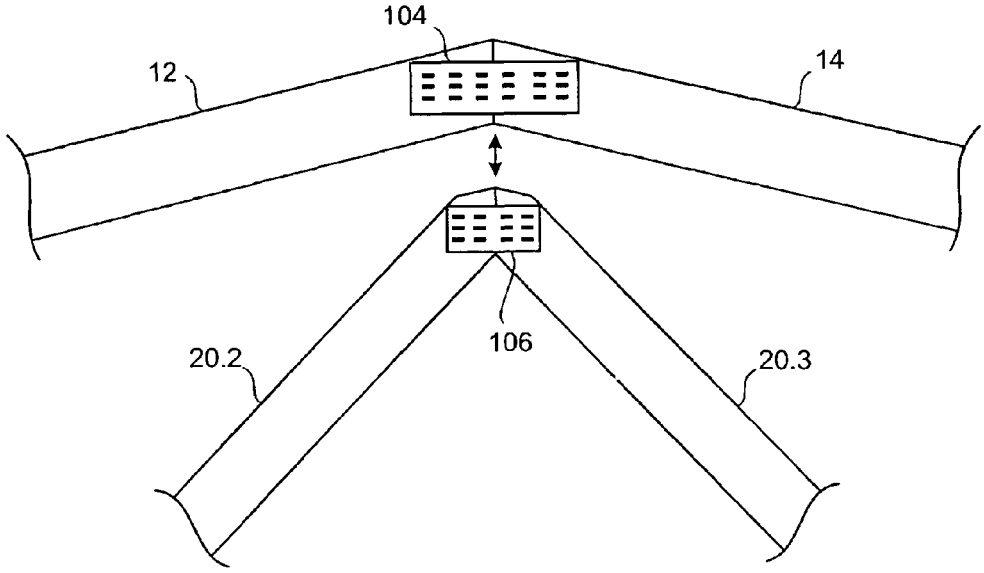

Referring to FIGS. 5*a* and 5*b*, simplified block diagrams of front view first embodiment of the expandable interface 102 according to the invention—in an exemplary implantation for intersection I in FIG. 1*c*—is shown. Here, the top chords 12 and 14 are joined using nail plates 104—on the front and the back side—and the web members 20.2 and 20.3 are joined using nail plates 106—on the front and the back side. It is possible to use, for example, standard nail plates stamped from 16-, 18-, or 20-gauge steel plates having integral nails 5/16" to 3/8" long with approximately 8 nails per square inch, depending on forces to be transferred. By separately joining the top chords 12 and 14 and the web members 20.2 and 20.3 relative movement between the top chords 12 and 14 and the web members 20.2 and 20.3 is enabled, as shown in FIG. 5*b*. Of course, the first embodiment of the expandable interface 102 is also applicable for other intersections and roof truss shapes.

Figure 6A:
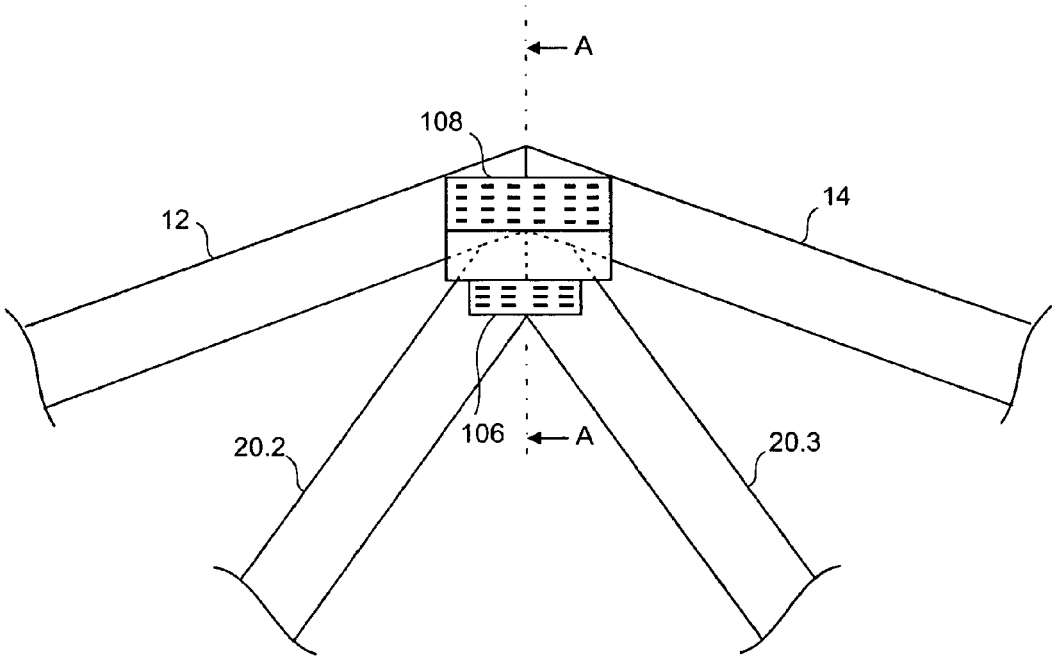
FIGS. 6*a* to 6*k* are simplified block diagrams of a second embodiment of the expandable interface according to the invention.
Figure 6B:
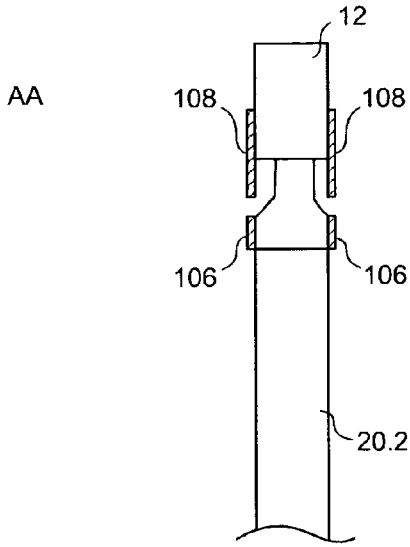
Figure 6C:
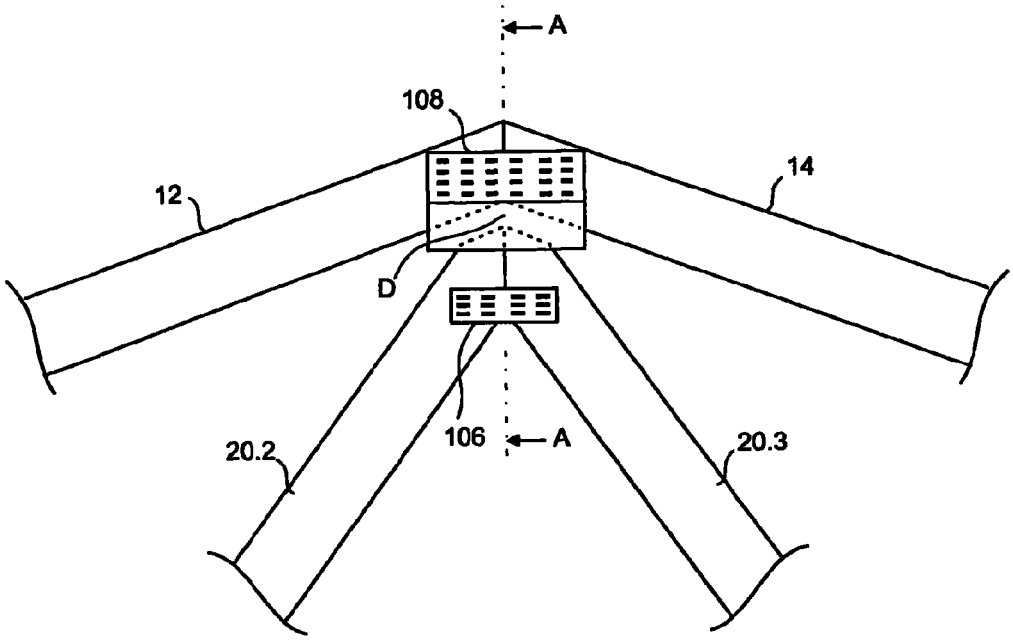
Figure 6D:
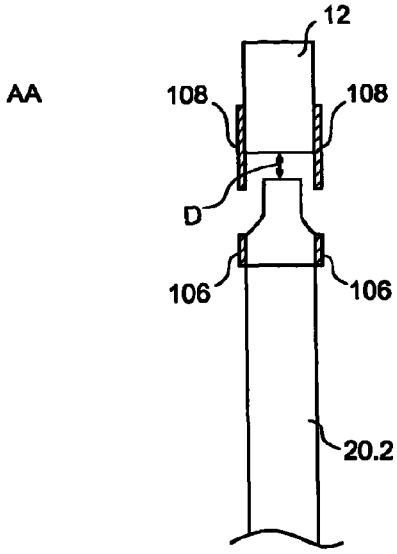
Figure 6E:
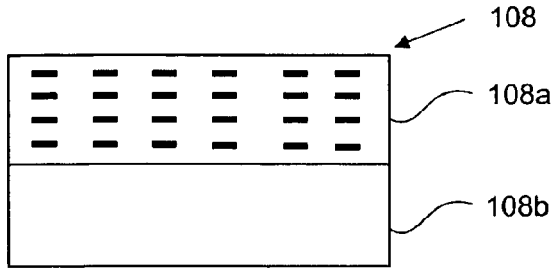
Figure 6F:
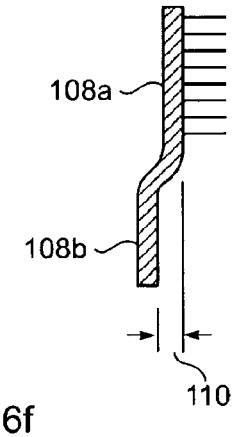
Figure 6G:
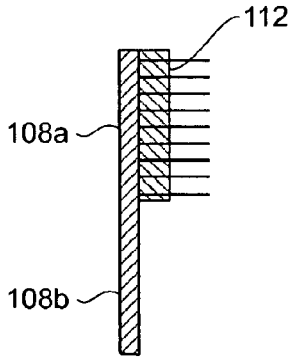
Figure 6H:
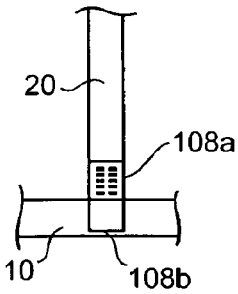
Figure 6I:
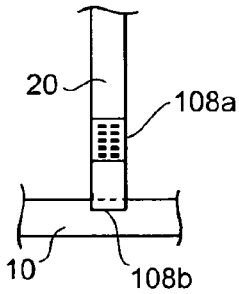
Figure 6J:
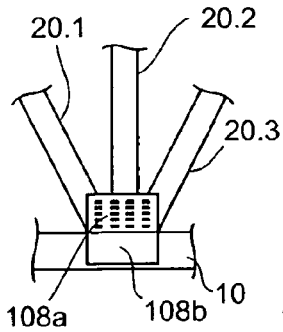
Figure 6K:
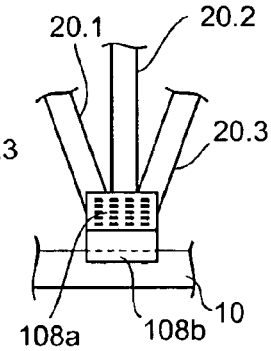

Referring to FIGS. 6*a* to 6*d*, simplified block diagrams of front views—FIGS. 6*a* and 6*c*—and cross sectional views—FIGS. 6*b* and 6*d*—of a second embodiment of the expandable interface 102 according to the invention—in an exemplary implantation for intersection I in FIG. 1*c*—is shown. The top chords 12 and 14 are joined using nail plates 108—on the front and the back side—and the web members 20.2 and 20.3 are joined using nail plates 106—on the front and the back side. Here, the expandable interface 102 comprises a guiding mechanism for enabling guided movement of the web members 20.2 and 20.3 in a plane described by the top chords 12 and 14 and the bottom chord 10. As shown in FIGS. 6*a* to 6*g*, the nail plates 108 comprise a mounting section 108*a* and a guiding section 108*b* with the guiding section 108*b* protruding the top chords 12 and 14 and movable accommodating an end portion—indicated by dashed lines—of the web members 20.2 and 20.3 therebetween as shown in FIGS. 6*a* to 6*d*. The guiding sections 108*b* are dimensioned such that the end portions of the web members 20.2 and 20.3 remain accommodated therebetween during a predetermined maximum relative movement D between the top chords 12 and 14 and the web members 20.2 and 20.3. For example, it is possible to determine the maximum relative movement in dependence upon the shape, the size, and the wooden material of the wooden roof truss and a difference between the relative humidity experienced by the top chords and the bottom chord. It has been found that in many situations guided relative movement of approximately 1" is sufficient. In order to movable accommodate the end portion of the web members 20.2 and 20.3 between the guiding sections 108*b*, the end portions comprise a thickness smaller than a thickness of the chords 12 and 14. In case the web members are made of material having a same thickness as the chords, the thickness of the end portion of the web members is reduced, as shown in FIGS. 6*b* and 6*d*, using for example a milling process. Alternatively, the guiding section 108*b* of the nail plates 108 is raised by a predetermined distance 110, as shown in a cross sectional view of FIG. 6*f* or, further alternatively, a raising layer 112 is interposed between the mounting section 108*a* of the nail plate 108 and the respective web member, as shown in a cross sectional view of FIG. 6*g*. For example, the raising layer 112 is made of a material that is penetrable by the nails—for example, a plastic material—or the layer comprises apertures for accommodating the nails therein. It is possible to form the nail plate 108, for example, from standard 16-, 18-, or 20-gauge steel plates using standard steel plate forming processes. Of course, the second embodiment of the expandable interface 102 is also applicable for other intersections and roof truss shapes such as, for example, the intersection I in FIG. 1*a*, shown in a front view in FIGS. 6*h* and 6*i*, and the intersection I in FIG. 1*b*, shown in FIGS. 6*j* and 6*k*. Here, the mounting sections 108*a* of the nail plates 108 are mounted to the web member 20—FIGS. 6*h* and 6*i*—or the web members 20.1 to 20.3 for connecting the same—FIGS. 6*j* and 6*k*—while the guiding sections 108*b* accommodate a potion of the respective chord 10 therebetween.

Figure 7A:
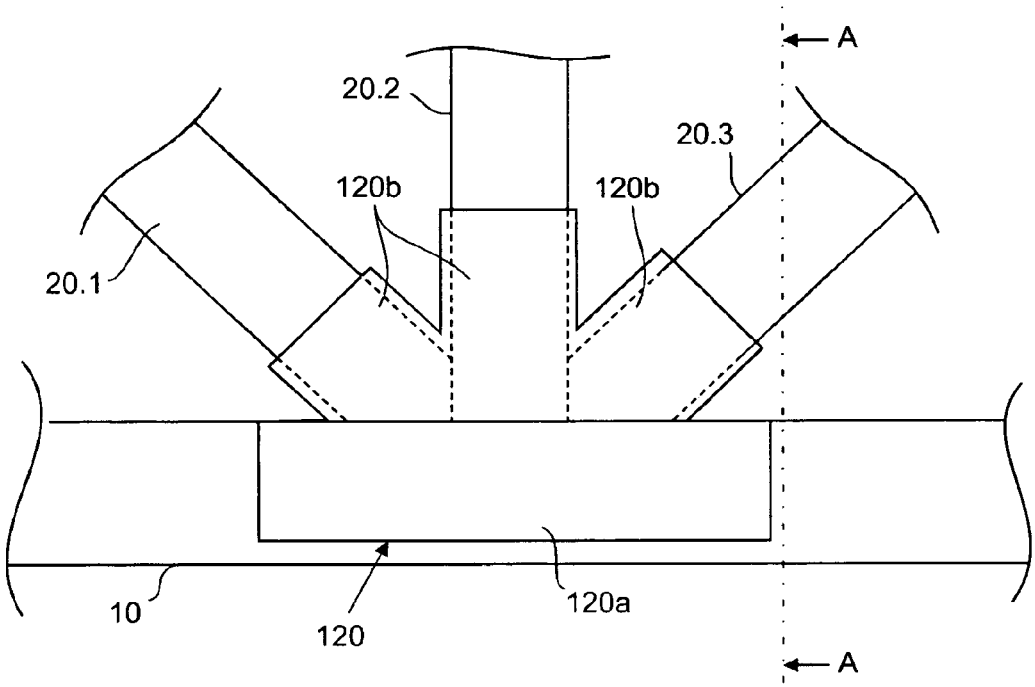
FIGS. 7*a* to 7*d* are simplified block diagrams of a third embodiment of the expandable interface according to the invention.
Figure 7B:
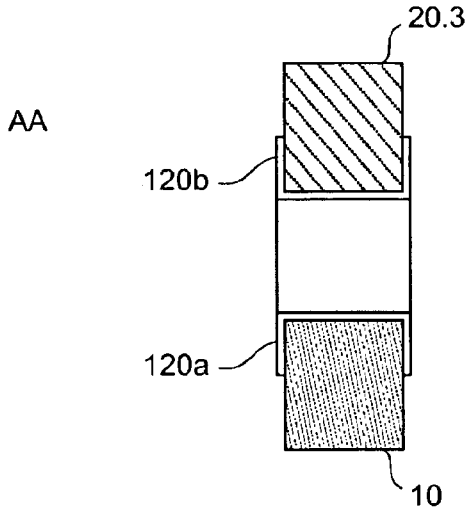
Figure 7C:
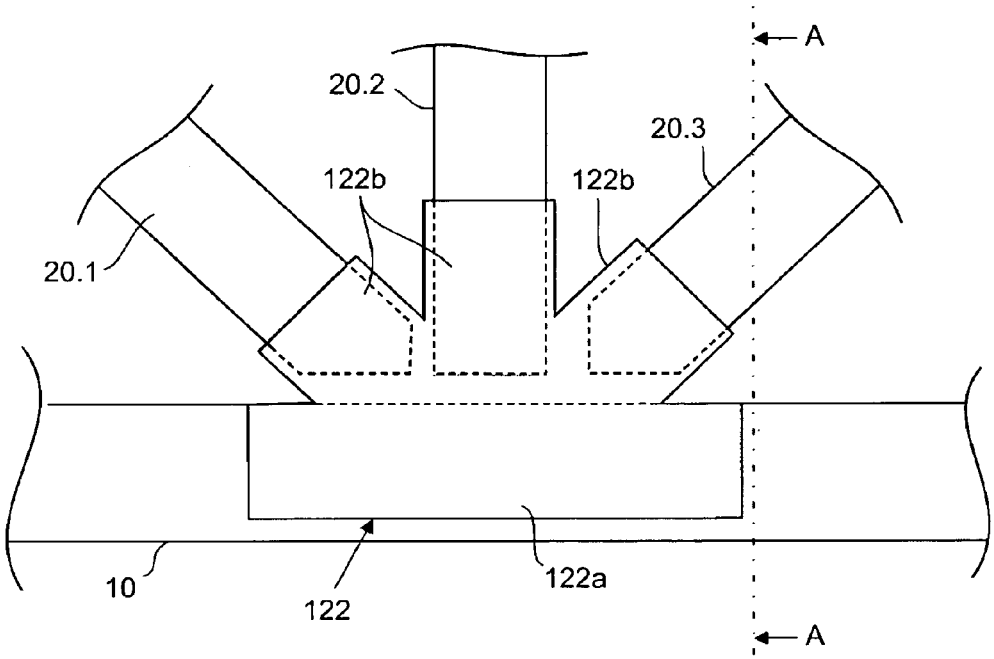
Figure 7D:
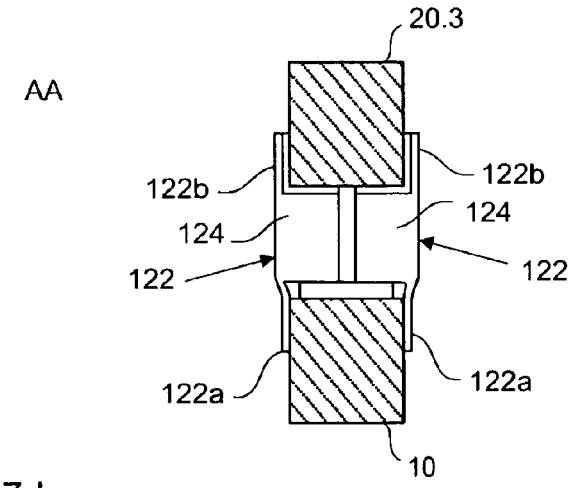

Referring to FIGS. 7*a* to 7*c*, simplified block diagrams of front views—FIGS. 7*a* and 7*c*—and a cross sectional view—FIG. 7*b*—of third embodiment of the expandable interface 102 according to the invention—in an exemplary implantation for intersection I in FIG. 1*b*—is shown. Here, a bracket 120 comprising a mounting section 120*a* and guiding sections 120*b* is mounted to the bottom chord 10 using, for example, nails or screws. An end portion—indicated by dashed lines—of each of the web members 20.1 to 20.3 is movable accommodated in a respective guiding section 120*b*. The bracket 120 enables substantially independent relative movement between each of the web members 20.1 to 20.3 and the bottom chord 10. As disclosed above with respect to the second embodiment the guiding sections 120*b* are designed to enable guided movement to a predetermined maximum distance. In order to facilitate implementation with state of the art manufacturing processes, the bracket 120 is, for example, provided in the form of two nail plates 122—one nail plate 122 mounted to the front side and one mounted to the back side of the bottom chord 10, as shown in a cross sectional view in FIG. 7*d*. The nail plate 122 comprises a mounting section 122*a* and raised guiding sections 122*b*. The guiding sections 122*b* each comprise guiding members 124 oriented substantially perpendicular to a plane of the mounting section 122*a* in order to properly guide the respective web member substantially parallel to its longitudinal axis. Again, it is possible to form the nail plate 122, for example, from a standard 16-, 18-, or 20-gauge steel plate using standard steel plate forming processes. Of course, the third embodiment of the expandable interface 102 is also applicable for other intersections and roof truss shapes.

Figure 8A:
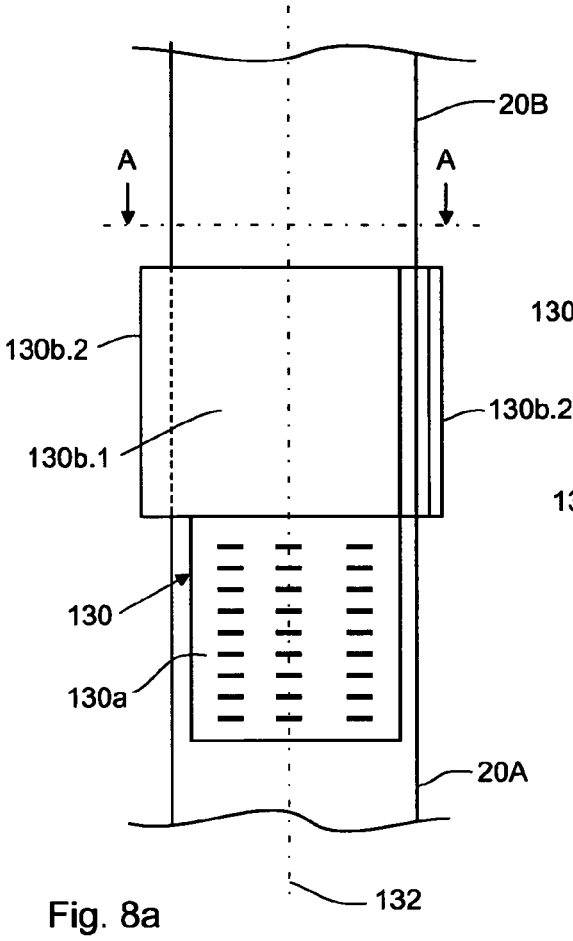
FIGS. 8*a* to 8*c* are simplified block diagrams of another expandable interface according to an embodiment of the invention.
Figure 8B:
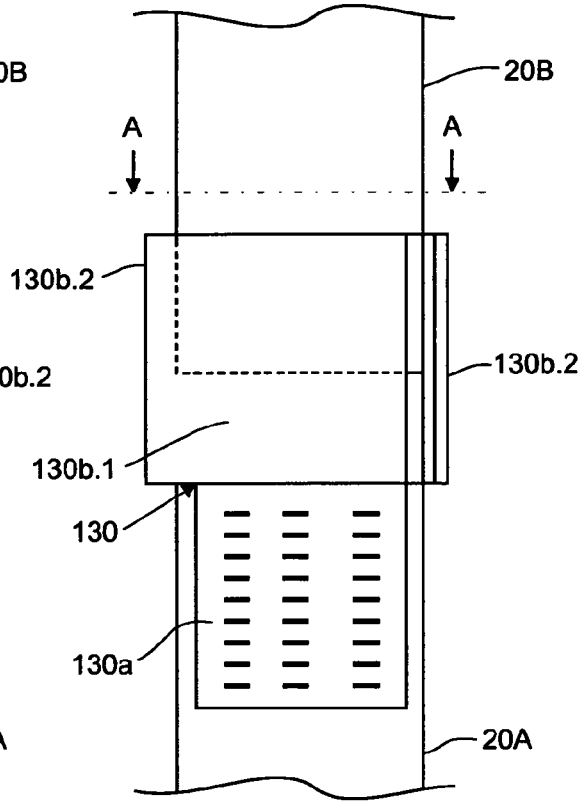
Figure 8C:
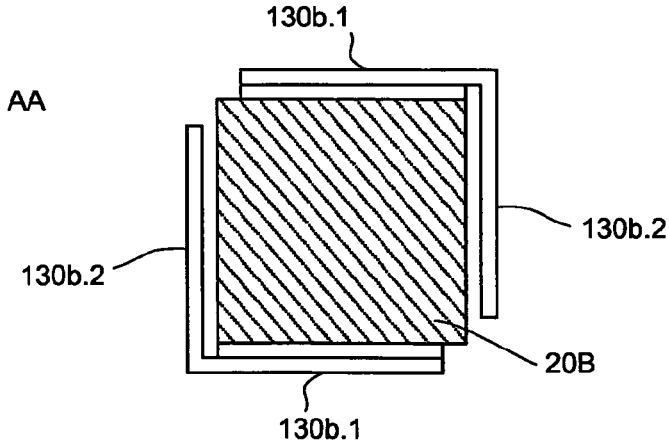

Referring to FIGS. 8*a* to 8*c*, simplified block diagrams of front views—FIGS. 8*a* and 8*b*—and a cross sectional view—FIG. 8*c*—of the expandable interface 103 according to an embodiment of the invention—in an exemplary implantation illustrated in FIG. 4—is shown. Here, the expandable interface 103 is interposed between a first portion 20A and a second portion 20B of the web member 20. The expandable interface 103 enables relative movement of the first portion 20A with respect to the second portion 20B substantially along a longitudinal axis 132 of the web member. Guiding is provided using two angled nail-plates 130—one nail plate 130 mounted to the front side and one mounted to the back side of the first portion 20A of the web member 20. The nail plate 130 comprises a mounting section 130*a* and a raised guiding section 130*b*. The guiding section 130*b* comprises a first plane portion 130*b*.1 oriented substantially parallel to the mounting section and a second plane portion 130*b*.2 oriented substantially perpendicular to the first plane portion 130*b*.1. The plane portions 130*b*.1 and 130*b*.2 of the two nail plates 130 movable accommodate an end portion of the second portion 20B of the web member 20 therebetween. It is possible to form the nail plate 130, for example, from a standard 16-, 18-, or 20-gauge steel plate using standard steel plate forming processes. Of course, the expandable interface 103 is applicable for various web members of other roof truss shapes. Alternatively, guiding is provided using a single piece—instead of the two angled plates 130—screwed or nailed to the end portion of first portion 20A of the web member 20.

It is noted, that those of skill in the art will readily arrive at numerous other techniques to enable guided relative movement such as, for example, by providing a pin oriented parallel to the relative movement which is accommodated in a respective bore.

The expandable interfaces disclosed above substantially reduce uplift of the bottom chord by enabling expansion of the distance A, while still enabling transmission of compression forces in situations where the respective web member(s) are in contact with the corresponding chord(s), for example, when the top and the bottom chords are exposed to a same level of relative humidity or when a heavy snow load is causing the top chords to bend inward.

In some situations it is beneficial to limit the relative movement provided by the expandable interfaces and to enable transmission of tension forces when the relative movement has reached a predetermined limit to counteract upward lifting forces acting on the top chords due to, for example, strong wind forces acting on the roof in cold conditions.

Figure 9A:
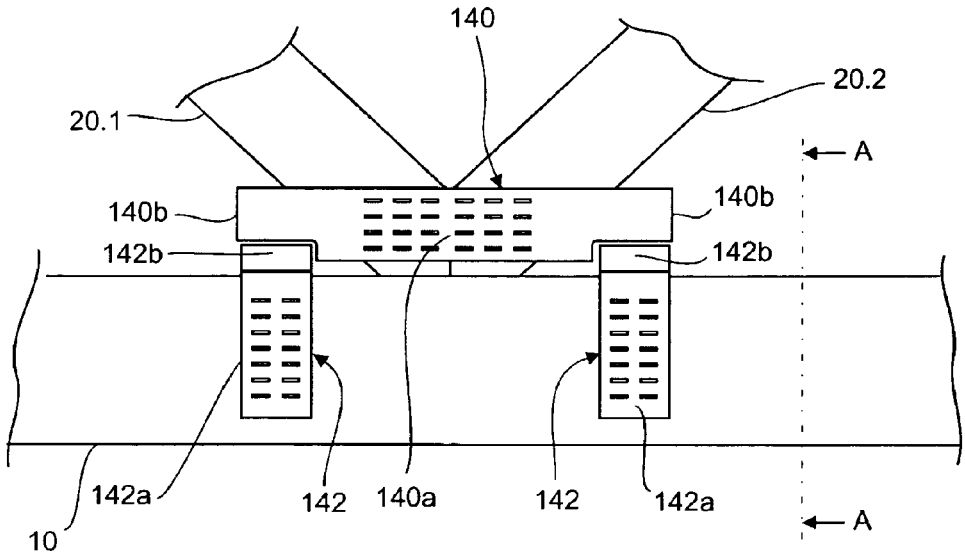
FIGS. 9*a* to 9*g* are simplified block diagrams of a fourth embodiment of the expandable interface according to the invention; and, FIGS. 10*a* to 10*g* are simplified block diagrams of various limiting mechanisms for use with the expandable interfaces according to embodiments of the invention.
Figure 9B:
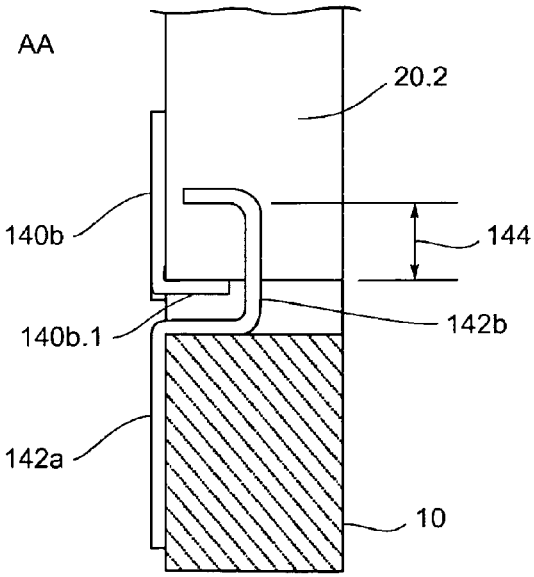
Figure 9C:
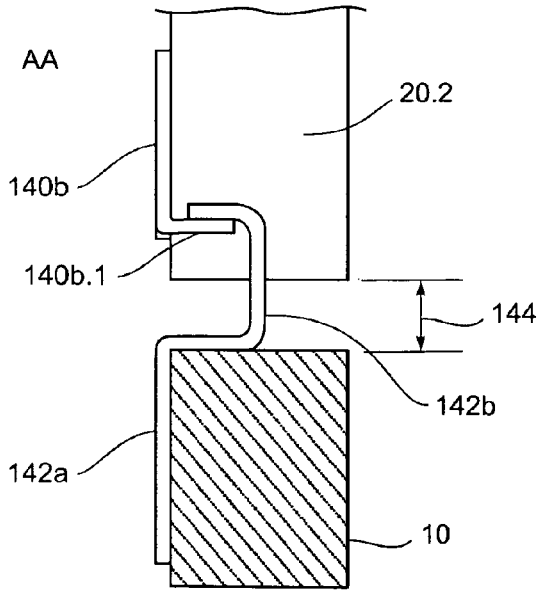
Figure 9D:
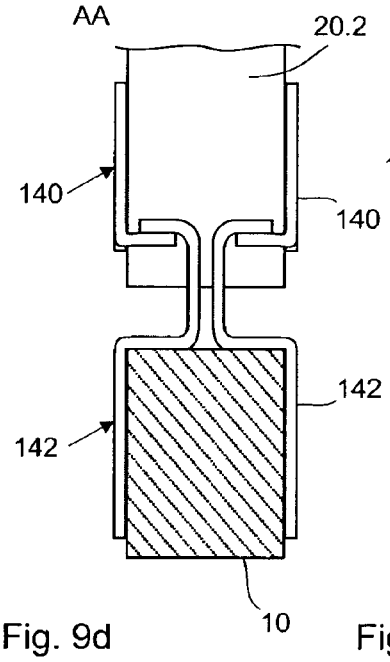
Figure 9E:
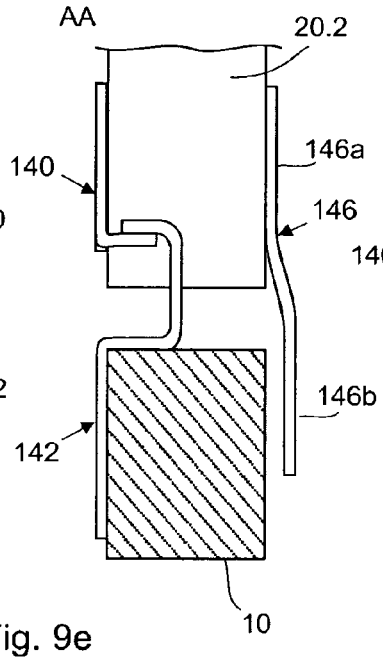
Figure 9G:
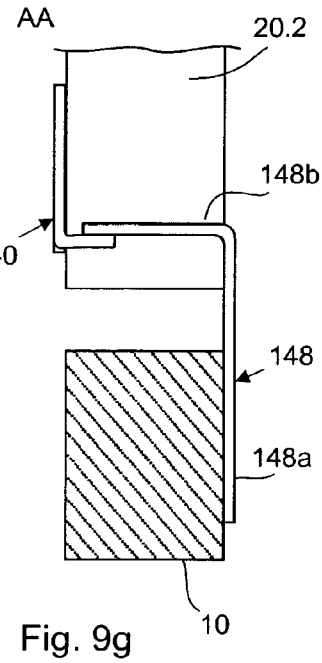
Figure 9F:
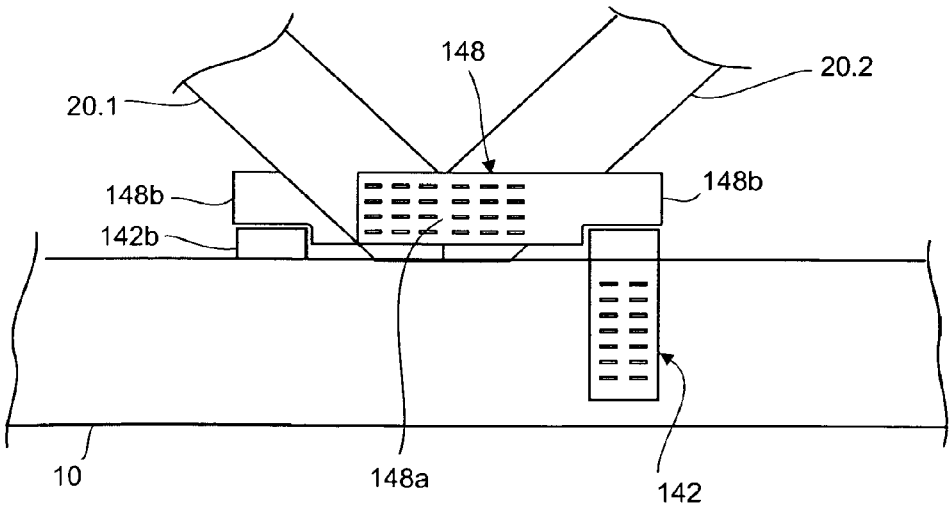

Referring to FIGS. 9*a* to 9*f*, simplified block diagrams of front views—FIGS. 9*a* and 9*f*—and cross sectional views—FIGS. 9*b* to 9*e*—of a fourth embodiment of the expandable interface 102 according to the invention—in an exemplary implantation for intersection II in FIG. 1*c*—is shown. The web members 20.1 and 20.2 are joined using a first structural member 140. The first structural member 140 comprises a mounting section 140*a*, for example, in the form of a nail plate, and an interacting section 140*b* protruding the web members 20.1 and 20.2 on a left hand side and a right hand side. The interacting section 140*b* comprises an interacting element 140*b*.1 oriented substantially perpendicular to the mounting section 140*a*. Second structural members 142, each comprising a mounting section 142*a* and an U-shaped interacting section 142*b*, are mounted to the bottom chord 10 such that a substantially horizontal oriented portion of the U-shaped interacting section 142*b* of each of the second structural members 142 is able to interact with a respective interacting element 140*b*.1 in order to abut the respective interacting element 140*b*.1 when an upper limit of a predetermined range 144 has been reached, as shown in FIGS. 9*a* to 9*c*. When the upper limit has been reached, as shown in FIG. 9*c*, the expandable interface is capable of transmitting a tension force between the web members 20.1 and 20.2 and the bottom chord via the abutted interacting element 140*b*.1 and the substantially horizontal oriented portion of the U-shaped interacting section 142*b*.

The first structural member 140 and the second structural members 142 are dimensioned such that relative movement between the web members 20.1 and 20.2 and the bottom chord is enabled within the predetermined range and that the interacting element 140*b*.1 is abutted when the upper limit of the predetermined range has been reached. For example, it is possible to determine the range of the relative movement in dependence upon the shape, the size, and the wooden material of the wooden roof truss and a maximum difference between the relative humidity experienced by the top chords and the bottom chord. It has been found that in many situations relative movement of approximately 1" is sufficient. It is possible to form the first structural member 140 and the second structural members 142, for example, from standard 16-, 18-, or 20-gauge steel plates using standard steel plate forming processes. For example, in order to facilitate the roof truss manufacturing process the first structural member 140 and the second structural members 142 are provided in a combined fashion having the correct predetermined range 144 using, for example an adhesive foil for holding the same in place prior installation. For installation the combined structure is placed onto the bottom chord 10 and the web members 20.1 and 20.2—with the web members 20.1 and 20.2 being in contact with the bottom chord 10—such that the first structural member 140 is centered with the web members 20.1 and 20.2 and a substantially horizontal portion of the U-shaped interacting section 142*b* of the second structural elements 142 is in contact with a top surface of the bottom chord and is then mounted using a hydraulic clamp. After mounting the adhesive foil is removed.

Provision of the first structural member 140 and the second structural members 142 on the front side as well as on the backside of the wooden roof truss, as shown in FIG. 9*d*, also provides guidance during the relative movement. Alternatively, the first structural member 140 and the second structural members 142 are only mounted to the front side while a guiding plate 146 comprising a mounting section 146*a* and a guiding section 146*b* is mounted to the backside of the web members 20.1 and 20.2, as shown in FIG. 9*e*. Further alternatively, the first structural member 140 comprises a single interacting section 140*b* for interacting with a single second structural member 142. Provision of same first structural members 140 comprising a single interacting section 140*b* and corresponding second structural members 142 on the front side as well as on the backside, as shown in FIG. 9*f*, also provides guidance during the relative movement.

Optionally, second structural members 148, each comprising a mounting section 148*a* and an L-shaped interacting section 148*b*, are mounted to the opposite side of the bottom chord 10 such that a substantially horizontal oriented portion of the L-shaped interacting section 148*b* of each of the second structural members 148 is able to interact with a respective interacting element 140*b*.1 in order to abut the same when an upper limit of the predetermined range 144 has been reached, as shown in FIG. 9*g*. The second structural member 148 is applicable, for example, in the variations shown in FIGS. 9*e* and 9*f*.

Of course, the fourth embodiment of the expandable interface 102—and its variations—is also applicable for other intersections and roof truss shapes.

Figure 10A:
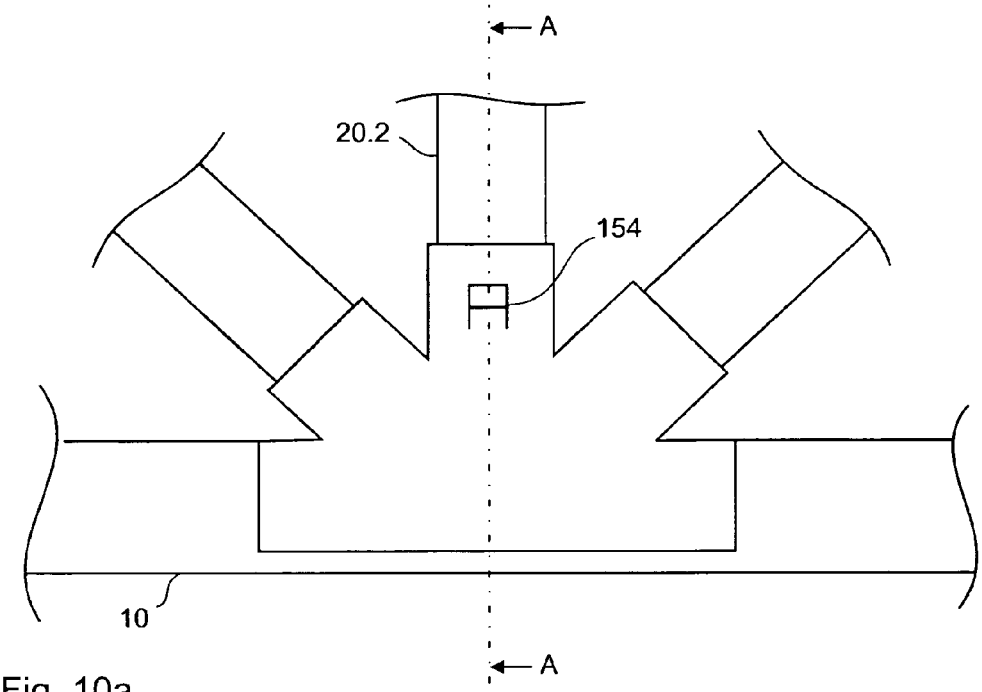
Figure 10B:
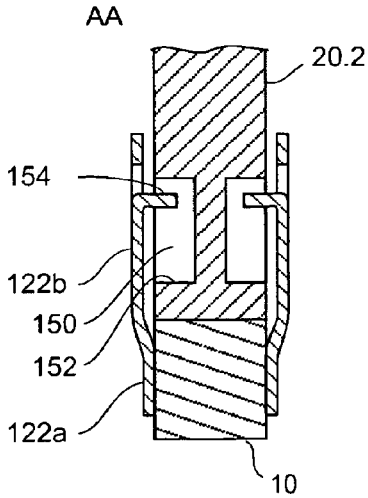
Figure 10C:
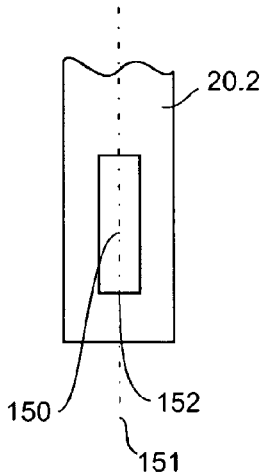
Figure 10D:
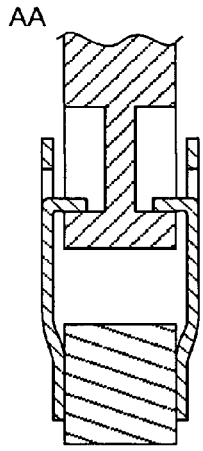
Figure 10E:
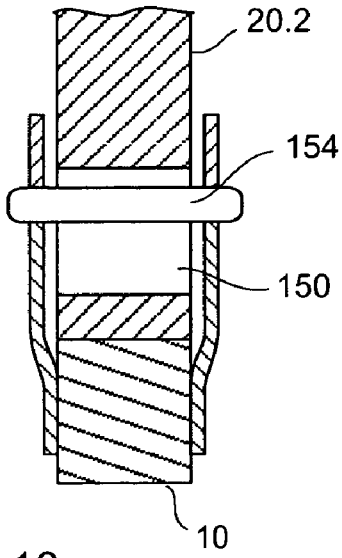
Figure 10F:
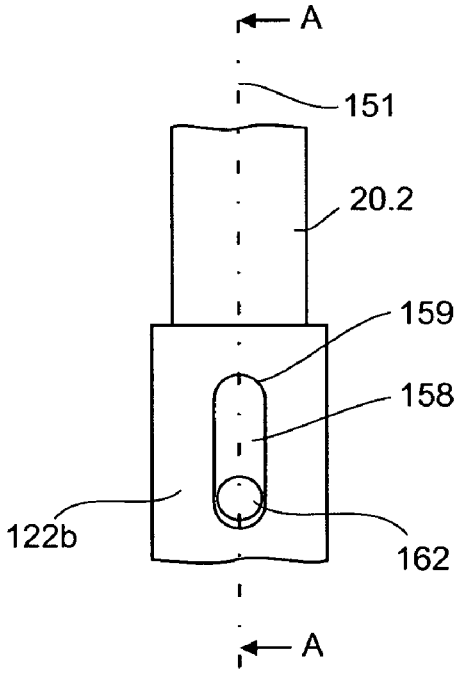
Figure 10G:
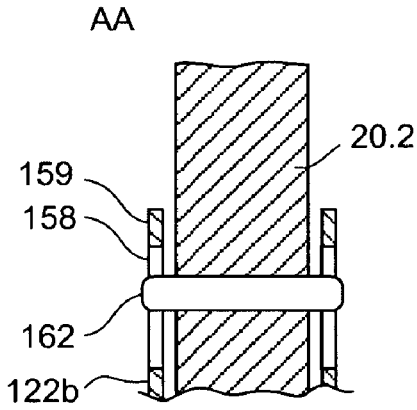

Referring to FIGS. 10*a* to 10*d*, a variation of the third embodiment of the expandable interface 102 comprising a limiting mechanism is shown. Here, the end portion of the web member 20.2 comprises an elongated aperture or groove 150 which is oriented substantially parallel to a longitudinal axis 151 of the web member 20.2, as shown in a cross sectional view illustrated in FIG. 10*b* and a front view of the web member 20.2. The aperture or groove 150 is terminated at termination 152 which is placed at a predetermined location along the longitudinal axis 151. A limiting element 154 is connected to the guiding section 122*b* of the bracket 122—which is provided in the form of two nail plates as described above—for abutting the termination 152 when the relative movement has reached a predetermined limit, as shown in FIG. 10*d*. The limiting element 154 is, for example, made as a punched and bent portion of the guiding section 122*b*, as shown in FIGS. 10*a*, 10*b*, and 10*d*. Alternatively, the web member 20.2 comprises an elongated aperture 150 and the limiting element 154 is a pin accommodated in respective apertures of the guiding sections 120*b*, 122*b* and fastened thereto, as shown in FIG. 10*e*. Further alternatively, the guiding section 122*b* comprises an elongated aperture 158 which is oriented substantially parallel to the longitudinal axis 151 of the web member 20.2 and comprises a termination 159 placed at a predetermined location along the longitudinal axis 151, as shown in FIGS. 10*f* and 10*g*. A limiting element 162 such as, for example, a pin is connected—for example, by using a tight fit with a respective bore—to the end portion of the web member 20.2 for being abutted by the termination when the relative movement has reached a predetermined limit. For example, it is possible to determine the locations of the terminations and the limiting elements in dependence upon the predetermined limit of the relative. In numerous applications it is sufficient to provide a single limiting mechanism for the bracket 120, 122, as shown, but as is evident, it is possible to employ the limiting mechanism for limiting the relative movement of more than one web member.

The same variations as shown in FIGS. 10*a* to 10*g* are also applicable for limiting the relative movement of the first portion 20A with respect to the second portion 20B of the web member 20 in the expandable interface 103 shown in FIGS. 8*a* to 8*c*. Furthermore, these variations are also applicable as limiting mechanism in the second embodiment of the interface 102 shown in FIGS. 6*a* to 6*k*.

In various situations it is sufficient to provide a single expandable interface of a plurality of expandable interfaces with a limiting mechanism. For example, the roof truss shown in FIG. 1*d* is provided with expandable interfaces at the intersections I, III, and IV of which the expandable interface at intersection I comprises a limiting mechanism.

Numerous other embodiments of the invention will be apparent to persons skilled in the art without departing from the spirit and scope of the invention as defined in the appended claims.

What is claimed is:

1. A wooden roof truss comprising:

a bottom chord, a first top chord, and a second top chord, the bottom chord, the first top chord, and the second top chord joined together forming a triangle with an apex spaced at a distance A from the bottom chord;

a web member disposed between the top chords and the bottom chord such that, in a first state of operation, the web member transmits a compression force between the top chords and the bottom chord; and, an expandable interface for expandably interfacing the web member with one of:

the first top chord;

the second top chord;

the first and the second top chord; and, the bottom chord, wherein the expandable interface supports, in a second state of operation, variation of the distance A between the apex and the bottom chord.

2. A wooden roof truss as defined in claim 1 wherein the expandable interface comprises a guiding mechanism for enabling guided movement of the expandably interfaced web member in a plane described by the first top chord, the second top chord, and the bottom chord.

3. A wooden roof truss as defined in claim 2 wherein the guiding mechanism comprises a first plate and a second plate, the first plate and the second plate each comprising a mounting section and a guiding section, wherein the mounting sections of the first plate and the second plate are mounted to a front side and a back side, respectively, of the expandably interfaced web member, and wherein the guiding sections of the first plate and the second plate movably accommodate a portion of the chord to which the web member is expandably interfaced therebetween.

4. A wooden roof truss as defined in claim 3 wherein the mounting section of the first plate and the second plate is used to connect one of:

at least two expandable interfaced web members; and, the first and the second top chord.

5. A wooden roof truss as defined in claim 3 wherein the mounting section of the first plate and the second plate forms a nail plate.

6. A wooden roof truss as defined in claim 1 wherein the expandable interface comprises a limiting mechanism for limiting movement of the expandably interfaced web member relative to the chord to which the web member is expandably interfaced.

7. A wooden roof truss as defined in claim 6 wherein the limiting mechanism comprises a first structural member mounted to the expandably interfaced web member and a second structural member mounted to the chord to which the web member is expandably interfaced, the first structural member movable relative to the second structural member within a predetermined range and for being abutted by the second structural member when an upper limit of the predetermined range has been reached.

8. A wooden roof truss as defined in claim 7 wherein the first structural member comprises a first plate having a first mounting section mounted to one of a front side and a back side of the expandably interfaced web member and having a first interacting section oriented substantially perpendicular to the first mounting section, and wherein the second structural member comprises a second plate having a second mounting section mounted to one of a front side and a back side of the chord to which the web member is expandably interfaced and having a second interacting section oriented substantially perpendicular to the second mounting section.

9. A wooden roof truss as defined in claim 8 wherein the second structural member comprises one of:

an L shape with the second mounting section mounted to a side opposite to the side the first mounting section is mounted; and, a U shaped interacting section with the second mounting section mounted to a same side the first mounting section is mounted.

10. A wooden roof truss as defined in claim 8 wherein the first mounting section is for connecting two expandably interfaced web members.

11. A wooden roof truss as defined in claim 8 wherein the first mounting section forms a nail plate.

12. A wooden roof truss as defined in claim 8 comprising a guiding plate mounted to a side opposite the first plate, the guiding plate comprising a mounting section and a guiding section with the guiding section protruding from the expandably interfaced web member and overlapping a portion of one side of the chord the web member is expandably interfaced with.

13. A wooden roof truss as defined in claim 8 wherein the first structural member comprises a front first plate mounted to the front side of the expandably interfaced web member and a back first plate mounted to the back side of the expandably interfaced web member, and wherein the second structural member comprises a front second plate mounted to a front side of the chord to which the web member is expandably interfaced and a back second plate mounted to a back side of the chord to which the web member is expandably interfaced.

14. A wooden roof truss as defined in claim 7 wherein the first structural member comprises a first plate having a first mounting section mounted to one of a front side and a back side of the expandably interfaced web member, a left hand side first interacting section and a right hand side first interacting section, the left hand side and the right hand side first interacting sections being oriented substantially perpendicular to the first mounting section, and wherein the second structural member comprises a left hand side second plate and a right hand side second plate, the left hand side and the right hand side second plates each having a second mounting section mounted to one of a front side and a back side of the chord to which the web member is expandably interfaced and a second interacting section oriented substantially perpendicular to the second mounting section.

15. A wooden roof truss as defined in claim 1 wherein the expandable interface is placed such that the expandably interfaced web member is a web member placed closer to a normal to the bottom chord through the apex than web members that are other than expandably interfaced.

* * * * *